United States Patent [19]

Volkers et al.

[11] Patent Number: 4,522,890

[45] Date of Patent: Jun. 11, 1985

[54] MULTILAYER HIGH ATTENUATION SHIELDING STRUCTURE

[75] Inventors: Jack C. Volkers; William R. Conley, both of Elgin, Ill.

[73] Assignee: Illinois Tool Works Inc., Chicago, Ill.

[21] Appl. No.: 540,106

[22] Filed: Oct. 11, 1983

Related U.S. Application Data

[63] Continuation of Ser. No. 328,987, Dec. 9, 1981, abandoned, which is a continuation-in-part of Ser. No. 89,435, Oct. 31, 1979, abandoned.

[51] Int. Cl.[3] ..... B21D 39/00; H01Q 17/00

[52] U.S. Cl. ..... 428/624; 428/625; 428/626; 428/635; 428/650; 428/651; 428/652; 428/653; 428/674; 428/675; 428/676; 428/677; 428/678; 428/679; 428/680; 428/681; 428/682; 428/683; 428/684; 428/685; 428/686; 428/925; 428/928; 343/18 A

[58] Field of Search ..... 428/624, 625, 626, 635, 428/650, 651, 652, 653, 674–686, 925, 928; 343/18 A

[56] References Cited

U.S. PATENT DOCUMENTS

| | | | |
|---|---|---|---|
| 2,996,710 | 8/1961 | Pratt | 343/18 A |
| 3,350,180 | 10/1967 | Croll | 428/928 |
| 3,680,107 | 7/1972 | Meinke et al. | 343/18 A |
| 3,756,788 | 9/1973 | Whetstone | 428/925 |
| 4,004,892 | 1/1976 | Ulam | 428/652 |
| 4,166,876 | 9/1979 | Chiba et al. | 428/215 |
| 4,167,606 | 9/1979 | Ulam | 428/652 |

FOREIGN PATENT DOCUMENTS

| | | | |
|---|---|---|---|
| 757490 | 9/1956 | United Kingdom . | |
| 1074895 | 7/1967 | United Kingdom . | |
| 1207670 | 10/1970 | United Kingdom . | |
| 1295241 | 11/1972 | United Kingdom . | |
| 1520872 | 8/1978 | United Kingdom . | |
| 398348 | 1/1974 | U.S.S.R. | 428/677 |

OTHER PUBLICATIONS

*Plastics Design Forum,* Mar./Apr. 1979, pp. 16–28, "Shielding Against Electromagnetic Interference".

Weast, R. C., ed.; *CRC Handbook of Chemistry Arel Physics,* 66th ed., pp. F 171–172, QD65C4(1979).

*Primary Examiner*—Veronica O'Keefe

*Attorney, Agent, or Firm*—Thomas W. Buckman; John P. O'Brien

[57] ABSTRACT

A composite structure of thin films including alternating layers of relatively high conductivity metals and low conductivity metals to combine the effects of reflection and absorption and thereby maximize the attenuation of the structure. Additionally, a similar structure of layers of materials with differing magnetic permeabilities may be used for the same purpose.

7 Claims, 4 Drawing Figures

MULTILAYER HIGH ATTENUATION SHIELDING STRUCTURE

BACKGROUND AND SUMMARY OF THE INVENTION

This application is a continuation of application Ser. No. 328,987, filed Dec. 9, 1981 which is a continuation-in-part application based on U.S. application Ser. No. 89,435 filed Oct. 31, 1979, by Jack C. Volkers and William R. Conley, both abandoned.

The present invention relates generally to a shielding structure for electromagnetic interference including radio frequency interference. The invention more particularly relates to a composite coating for plastic substrates which provides an effective shield for RFI and EMI.

With the growing replacement of metal housings by plastic housings in TV, audio equipment, medical instruments, process controls, computers, microprocessors and other sources of electromagnetic or radio frequency radiation, the problem of interference created by the components within the housing or effect of radiation created outside the housing on the components within the housing becomes important. Since plastic is a material which is essentially transparent to such radiation, no natural shielding exists as it does in metal housings.

RFI or EMI shielding on plastic housings has typically been accomplished by several methods giving varying amounts of attenuation or decrease in magnitude of transmission of the RFI or EMI through the housing. For example, spraying the plastic with a conductive paint has been utilized in certain applications. A high conductivity material, such as silver or copper, is added to the paint to provide layers heavily embedded with metallic particles when the paint is sprayed on a substrate. This type of painting technique, while capable of attenuation, is subject to adhesion problems and nonuniform metal fill in the coating on the substrate.

Plastic material which includes conductive materials has also been used to affect the shielding of radio frequency energy. However, frequently the addition of these materials compromises the strength and other factors leading to the decision to use plastics as the housing.

Vacuum deposition techniques are also used to obtain a thin film of conductive material and generally provide acceptable attenuation values depending on the material used and frequencies desired to be shielded. It is relative to this type of technique that the invention is directed. More particularly the invention involves an improved, multilayer shielding structure produced by a vacuum deposition technique and, as will be pointed out later herein, an ion deposition technique being the preferred manner of depositing several layers of film as contemplated herein.

Attenuation, as is used here, is a reduction of signal strength as the signal passes through an obstruction—in this case a plastic housing with a vacuum deposited film or series of films. Attenuation is given in decibels (dB) from the equation:

$$\text{Attenuation (dB)} = +20 \log A/Ao = -20 \log Ao/A$$

where, Ao is the original signal amplitude and, A is the remaining signal amplitude after passing through the obstruction.

Attenuation of the signal generally occurs by reflection of the signal and/or by absorption of energy. A brief description of both of these phenomena will help to explain this invention.

Reflection:

As a signal travels through one medium and encounters an interface with another medium, the signal is either reflected or transmitted or (more commonly) is partially reflected and partially transmitted.

By defining a predetermined signal with energy Eo which approaches an interface of media, and defining $E_R$ as the reflected energy and $E_T$ as the transmitted energy, a reflection coefficient R and transmission coefficient T can be defined as follows:

$$R = E_R/E_o$$

$$T = E_T/E_o$$

Note that $E_R + E_T = E_o$ and therefore $R + T = 1$.

Some general statements concerning R and T can be made:

1. If the signal in question is in a medium of relatively lower conductivity and encounters a medium of higher conductivity, then most of the energy of the signal is reflected, or:

$$R_{L\to H} > T_{L\to H}$$

2. If the signal travels from a higher conductive medium to a medium of lower relative conductivity then most of the energy of the signal is transmitted, or:

$$T_{H\to L} > R_{H\to L}$$

3. The above relationships are especially pronounced for interfaces where the media have ratios of resistivity in the order 10:1; and the higher conductive material has a resistivity $\leqq$ 5Microohm-cm. In which case the above expressions become:

$$R_{L\to H} >> T_{L\to H}$$

$$T_{H\to L} >> R_{H\to L}$$

4. The above expressions are equally valid for interfaces where the two media differ in magnetic permeability. For example, if the signal travels from a medium of high permeability to a medium of lower permeability, most of the energy is transmitted, or:

$$T_{H\to L} > R_{H\to L} \text{ etc.}$$

5. For interfaces of media where both the conductivity and the permeability are substantially different the controlling property is the skin depth, δ, which is proportional to the square root of the inverse product of the conductivity, the permeability and the frequency of the signal, or:

$$\alpha \propto \frac{1}{\sqrt{f\sigma\mu}}$$

where f is the frequency of the signal, $\sigma$ is the conductivity and $\mu$ is the magnetic permeability. Then the above relationships become:

$$R_{H\delta \to L\delta} > T_{H\delta \to L\delta}$$

$$T_{L\delta \to H\delta} > R_{L\delta \to H\delta}$$

Realizing always that this represents the interaction of the conductivity and permeability, we will discuss them separately for simplification.

A special consideration when reflecting a signal from a thin film is the thickness of the film. Since reflection is a near-surface phenomenum, there is a necessary minimum film thickness to obtain maximum reflection. A thickness greater than this minimum will not increase the reflected signal. This thickness, which may be different for different materials, is easily determined from experiment. We refer to this thickness as the "thickness at the point of opacity." For example, with reference to aluminum, the minimum thickness for maximum reflection is approximately 3000 angstroms.

Absorption:

As a signal traverses a medium, some of its energy is dissipated in the medium in the form of heat. The energy of a signal as a function of the distance it travels through a medium is given by:

$$E(x) = E_o e^{-2x/\delta}$$

where, $E_0$ is the original energy, E(x) is the remaining energy, x is the distance traveled in the medium and $\delta$ is the "skin depth" or the depth at which the remaining energy is $1/e^2$ the original energy. (Corresponds to $\approx -9$ dB attenuation) For a good conductor $\delta$ is proportional to $$\frac{1}{\sqrt{\mu\sigma}};$$

where $\mu$=magnetic permeability and $\sigma$=conductivity. Conductivity being the inverse of the resistivity, $\rho$; such that $$\sigma = \frac{1}{\rho}.$$

For example, for a signal having a frequency of 100 Mhz, traveling through copper, which has a high conductivity ($\rho$=1.7 ohm-cm), and a low permeability ($\mu$=1), the skin depth is 71,000 angstroms. To provide −36 dB attenuation, by absorption only, 4 "skin depths" (each skin depth yields$\approx -9$ dB). The necessary material thickness would then be:

$$4 \times 71{,}000 \text{ Å} = 284 \text{ KÅ}$$

or a little over 0.001 inches.

The skin depth for the same signal, i.e. 100 Mhz, traversing a highly permeable material, e.g. ($\mu \simeq 10^5$), will be in the order of 1 KÅ. In this example it can be seen that much of its energy is absorbed while traversing only a short distance.

The invention described herein takes advantage of both reflection and absorption phenomena by causing a signal to be "trapped" in a lower conductivity material by having higher conductivity layers on either side of the lower conductivity material. As the signal encounters the low-high interface, the major portion of its energy is reflected back into the lower conductivity material; thus, it continues to traverse this medium, continually dissipating its energy. Additionally, a first layer of lower conductivity material will enhance the total reflected portion of the signal by providing a series of low high reflective interfaces.

Understanding of the invention will be facilitated by referring to the accompanying drawings.

DETAILED DESCRIPTION OF THE PREFERRED EMBODIMENT

Figure 1:
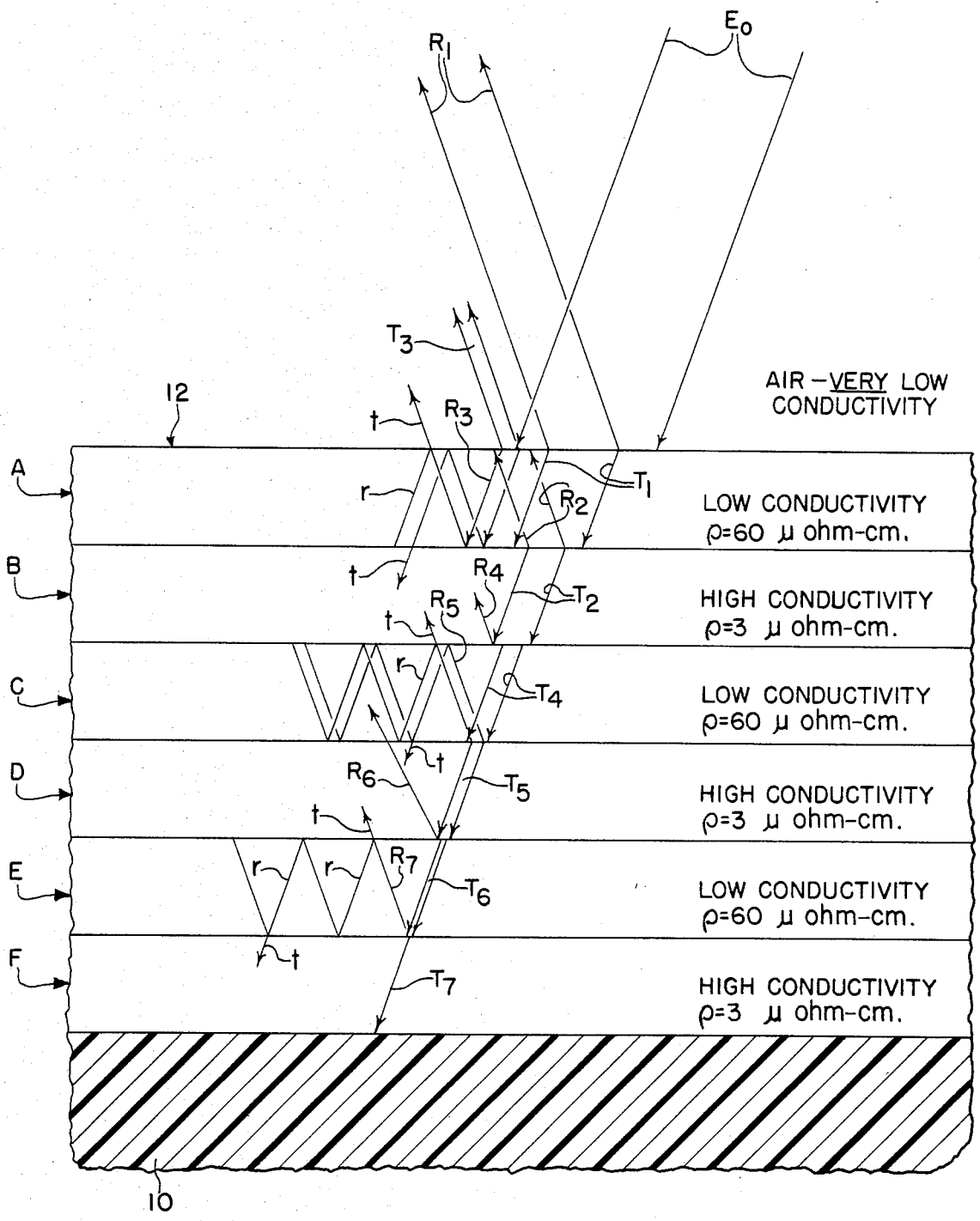
FIG. 1 is an enlarged cross-sectional view of the multilayer shielding structure characterizing typical disposal paths of waves of RF or EM energy through such a structure.

Turning first to FIG. 1, the essence of the invention will be described relative to the various layers on a substrate or housing 10. Housing 10 is shown to be of a plastic material and which is provided with a multilayer shielding structure according to the invention. This composite shielding structure is referred to as 12. The shielding structure 12 comprises thin conductive layers A, B, C, D, E and F, with each layer having the relative conductivity noted on the drawing, i.e., for the A layer $\rho = 60\mu$ ohm-cm, for the B layer $\rho = 3\mu$ ohm-cm, etc. It will be apparent that a relatively high resistivity ($\rho$) denotes a relatively low conductivity material; that is, a material with a relatively high skin depth. It follows that a relatively low resistivity ($\rho$) denotes a relatively high conductive material; that is, a material with a relatively low skin depth. In this example, A is the layer exposed to the air and F is the layer which is contacting the substrate.

As a representative wave of energy $E_o$ encounters the top layer A, which is of relatively low conductivity, the major portion of the wave energy is reflected as $R_1$, since the conductivity of layer A is still much greater than that of air. This reflected portion, $R_1$, is no longer of consequence to the system. The portion of the wave $E_o$ that enters the first layer and is transmitted therethrough is represented by $T_1$. As the transmitted portion $T_1$ of the wave encounters the next interface AB, again the major portion of its energy is reflected as $R_2$, since the interface AB is that of a lower conductivity material to a higher conductivity material. The remaining portion of transmitted portion $T_1$ is transmitted through layer B as $T_2$. Note that as the reflected wave $R_2$ exits through the air interface, the major portion of the wave is transmitted therethrough as $T_3$ and leaves the system. There is, however, a very small reflected portion $R_3$ which is additive to transmitted portion $T_1$.

As $T_2$ now encounters the high→low interface BC, the major portion of this wave is transmitted as $T_4$. A small portion is reflected as $R_4$, and this portion exits the system through the above two high→low interfaces. Minor reflections, r, at these interfaces are additive to $T_2$ and $T_1$.

As $T_4$ encounters the low→high interface CD, the major part of this transmission is reflected as $R_5$. As shown in FIG. 1, $R_5$ now continues to see low→high interfaces CB and CD as it is "trapped" in the layer C of lower conductivity material with only minor transmissions, t, at the interfaces. These minor transmissions are additive to either $R_4$ or $T_5$, with $T_5$ being the smaller portion of $T_4$ that is transmitted through interface CD. As $R_5$ travels within this lower conductivity layer, its energy is dissipated by absorption until it is no longer significant.

Remaining transmission $T_5$ then encounters another high→low interface DE where a major portion of it is transmitted as $T_6$, and a minor remaining portion is reflected as $R_6$. This reflected portion $R_6$ is additive to $R_5$.

The transmission $T_6$ then encounters a low→high interface EF and as in the discussion relative to interfaces CD and CB, the major portion of this transmission is reflected as $R_7$ and trapped in layer E between the low→high interfaces EF and ED.

The final transmitted signal is $T_7$ plus some minor transmissions as $R_7$ reflects from the low→high interface. The total reflected signal is $R_1$ plus $T_3$ as well as some minor transmissions which were reflected back. The total absorbed signal which is dissipated within a low conductivity layer is $R_5$ plus $R_7$ plus some minor reflected signals that would have been added thereto. Thus it is apparent that a very small portion of the original signal $E_o$ is able to pass through structure 12.

The above example deals with layers of different electrical conductivity. However, it should be understood that a similar structure can be made using materials of different magnetic permeabilities or different combinations of conductivity and permeability, since the relationships between the transmitted and reflected portions of each wave in a structure made of such materials would be similar to those in the above example.

Additionally, it should be understood that while an external film substrate is shown, similar effects will be obtained with an internal coating or shielding structure since the nonconductive substrate (plastic housing) is essentially transparent to RF or EM signals. It should be noted that, while the layers of the multilayered structure may be arranged to attenuate wave energy approaching from outside of the housing or from inside of the housing, the multilayers may be arranged to effectively attentuate wave energy from either inside or outside.

Figure 2:
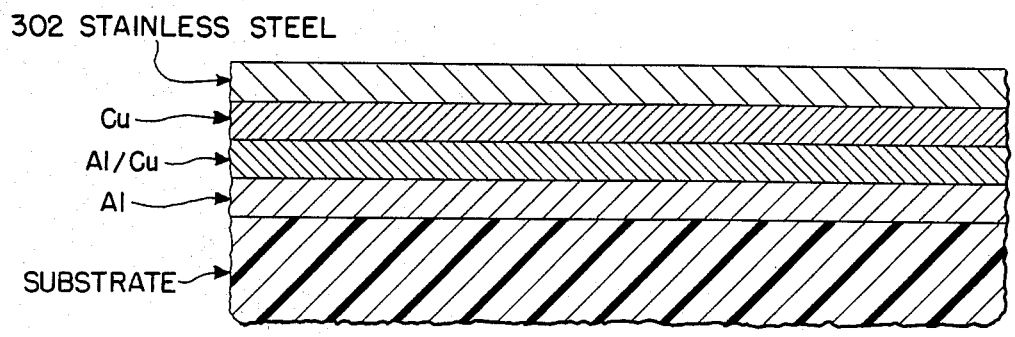
FIG. 2 is an enlarged cross-sectional view of one example of the shielding structure of the invention.

Turning now to FIG. 2, a typical example of the shielding structure of the invention is shown utilizing alternating high and low conductivity layers. A series of layers of aluminum, aluminum-copper alloy, copper, and 302 stainless steel are formed over a plastic substrate. It will be apparent that this structure is substantially identical to that of FIG. 1 with the resistivities of the layers being approximately 2.7, 100, 1.7, and 70, respectively. All of the examples in FIGS. 1–4 refer to resistivities ($\rho$) in $\mu$ ohm-cm.

Figure 3:
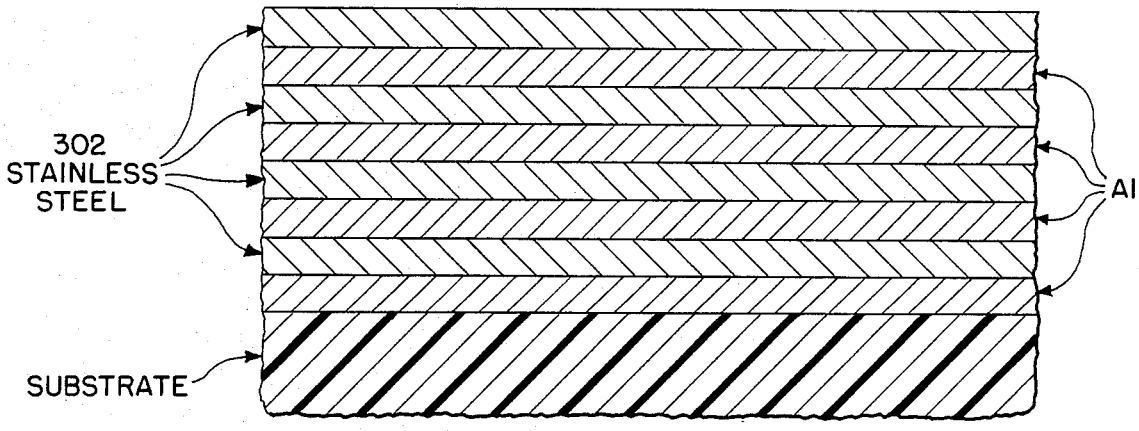
FIG. 3 is an enlarged cross-sectional view of another example of the shielding structure of the invention.

FIG. 3 shows yet another example of the shielding structure of the invention utilizing alternating high and low conductivity layers with every other layer being of the same material. The plurality of layers are of aluminum interspersed between alternating layers of stainless steel. Aluminum has a resistivity of approximately 2.7 and stainless steel, approximately 70.

Figure 4:
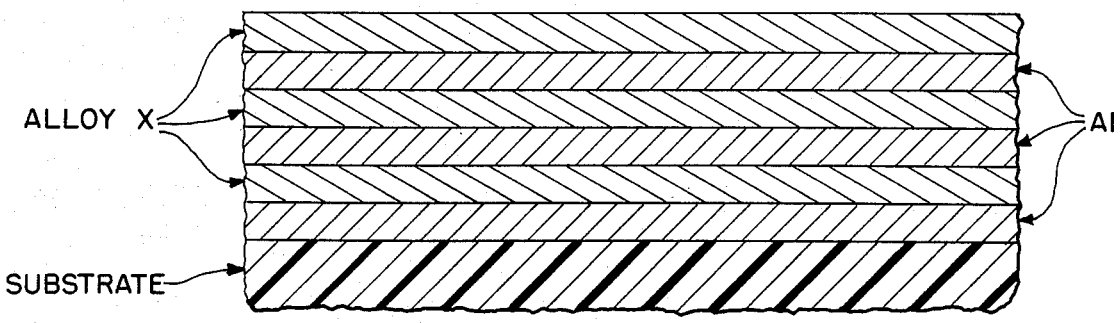
FIG. 4 is an enlarged cross-sectional view of another example of the invention utilizing materials of different magnetic permeability as the alternating layers of conductive material.

FIG. 4 shows an alternative example of the invention wherein a plurality of layers of material of a high magnetic permeability are interspersed between layers of a very conductive material, namely aluminum. The aluminum has a normal coefficient of magnetic permeability of $\mu=1$. The high permeability alloy X interspersed between the aluminum layers may be a composition of 15.7% Fe, 79% Ni, 5% Mo, 9.3% Mn with $\mu \approx 100{,}000$.

Obviously, the materials utilized in such a multilayer shielding structure are a matter of choice. The structure shown in FIG. 2, where each layer has a thickness of approximately 3–5 thousand angstroms produced −45 dB attenuation over the range from 65–265 Mhz. This is compared to attenuation factors in the order of −20 dB for copper paint over the same frequency ranges and −35 dB for a single thin layer of aluminum or a single layer of silver paint.

A further aspect of the invention is the thickness of the films or layers themselves. It is preferred that the layers be very thin films formed as by vapor deposition and preferably by ion deposition as will be discussed later herein.

It is apparent from the above discussion that for maximum effect, the reflections from interfaces with the higher conductivity material should be maximized. Then the higher conductivity material should have a film thickness equal to or greater than the thickness at the point of opacity for the particular material, since a thicker film would not cause greater reflection. Also apparent from the above discussion, there is no such minimum thickness for the lower conductivity material since it is not important to maximize reflections from interfaces with the lower conductivity material. Thus, it has been found that the thickness of each layer of the lower conductivity material is not as critical as the thickness of the layers of higher conductivity material. It has been found that when each layer of the higher conductivity material is deposited at or near its thickness at its point of opacity an effective multilayer shielding structure is produced when the interspersed layers of lower conductivity material are applied at or near the same thickness as the layers of higher conductivity material. The same discussion is also true when considering layers of differing permeabilities. Thus a preferred thickness of each layer of the film of the higher permeability material is the point of opacity for the material in that layer, as previously discussed. Obviously, all of the films contemplated by the invention are very thin as typified by a vacuum deposition technique.

The use of an ion deposition technique as discussed in U.S. Pat. No. Re. 30,401 is particularly advantageous in practicing this invention since the technique described therein is capable of plating a thin film of any conductive material on a substrate of plastic. Furthermore, the ion deposition technique is capable of providing a degree of uniformity of coating thickness even when the substrate includes deeply recessed areas that should be coated for shielding. Since the ion deposition is not a straight line technique, it is particularly effective in producing the layers desired by this invention.

As a practical matter, when a substrate which has a very irregular surface is having thin films applied to it, the thickness of the films on different areas of the substrate may vary and yet be effective. It has been found that the thickness of the higher conductivity materials, (the critical layers for thickness ) may vary from a thickness of about half of the thickness at the point of opacity to a thickness of about five times the thickness at the point of opacity for the particular material (for copper this is a range of $\approx$1,000–10,000 angstroms) and yet provide effective attenuation. Ideally, the minimum thickness of each of the layers of the higher conductivity material, in the most difficult areas to plate, will be at least the thickness at its point of opacity. Which means, due to irregular deposition, at times, there may be areas where the film will be somewhat thicker, e.g., three or four times the thickness of the material at its point of opacity. This is due to the fact that, even when using the ion deposition technique, the thickness of the layer of material deposited may not be perfectly uniform across the entire surface of the substrate.

It is contemplated herein that multiple layers as described herein can also be used to enhance the shielding effectiveness of structures having coatings deposited thereon by techniques other than vacuum deposition and/or which would not be considered thin film techniques. While other techniques may be employed which may apply substantially thicker films, the same minimum film thicknesses still apply.

It should also be apparent that while the shielding structure described herein is particularly effective on plastic or nonconductive substrates, it will also be effective as an RFI or EMI shield for conductive substrates.

While any variety of metals can be utilized and come within the scope of this invention, particularly effective combinations of layers would have a ratio of conductivity or permeability in the order of 20:1. This will provide the multiple reflections and absorptions desired to enhance and maximize the attenuation.

It should be further noted that any sequence of placement of the various layers can be utilized and still come within the scope of the invention as long as there is in some way a plurality of layers with lower conductivity layers sandwiched between higher conductivity layers, or interspersed layers of different permeability. The examples shown in FIGS. 2 and 3 describe a lower conductivity layer of 320 stainless steel material at the top surface. This is to provide a certain amount of corrosion resistance to the overall structure. However, for various functional and aesthetic purposes, any series of materials can be used.

Clearly the economics of this invention should be readily apparent. The advantage being that an inexpensive molded plastic substrate may be used and that it may be made essentially impervious to electro-magnetic interference by the use of thin metallic films.

It is to be understood that the form of our invention, herewith shown and described, is to be taken as a preferred example of the same, and that various changes may be made in the shape, size and arrangement of the parts thereof, without departing from the spirit of the invention or the scope of the subjoined claims.

Having thus described our invention, we claim:

1. The combination of an electrically nonconductive substrate and a composite electro-magnetic shield structure, said shield structure disposed on one side of said substrate for shielding the opposite side of said substrate from electro-magnetic interference, said structure comprising a plurality of thin layers of conductive material, wherein each successive layer alternates from one having a relatively low skin depth and low electrical conductive resistivity to one having a relatively high skin depth and high electrical conductive resistivity and wherein the layers having a relatively low skin depth have a thickness of no less than the thickness of that particular material at its point of opacity in the radio frequency range.

2. The combination of claim 1, wherein said composite electro-magnetic shield structure comprises at least three layers of conductive material including alternating layers of material wherein each alternating layer has either relatively low skin depth or a relatively high skin depth.

3. The combination of claim 1, wherein the nonconductive substrate is a plastic housing and wherein the shield structure is laminated on the exterior of said plastic housing.

4. The combination of claim 1, wherein the nonconductive substrate is a plastic housing and the shield structure is laminated on the interior of said plastic housing.

5. The combination of claim 1, wherein each of said layers of said composite electro-magnetic shield structure is formed by an ion deposition technique.

6. The combination of claim 1, wherein the adjacent relatively high electrical conductivity and relatively low electrical conductivity layers of said composite electro-magnetic shield structure present a ratio of generally 20:1 in electrical conductivity at their interfaces.

7. The combination of claim 1, wherein each layer of said composite electro-magnetic shield structure has a thickness which is generally the thickness for the particular material at its point of opacity and wherein the adjacent relatively high electrical conductivity and relatively low electrical conductivity layers have ratios of resistivity in the order of 10:1 with said high electrical conductivity material having a resistivity less than or equal to 5 microohm-cm.

* * * * *